US006161399A

United States Patent [19]

Jayaraman

[11] Patent Number: 6,161,399

[45] Date of Patent: Dec. 19, 2000

[54] PROCESS FOR MANUFACTURING A WIRE REINFORCED MONOLAYER FABRIC STENT

[75] Inventor: Swaminathan Jayaraman, Dallas, Tex.

[73] Assignee: Iowa-India Investments Company Limited, Isle of Man, United Kingdom

[21] Appl. No.: 09/108,774

[22] Filed: Jul. 2, 1998

Related U.S. Application Data

[63] Continuation-in-part of application No. 08/957,514, Oct. 24, 1997, abandoned.

[51] Int. Cl.[7] ..... D04B 25/02; A61F 2/06

[52] U.S. Cl. ..... 66/170; 66/192; 623/1; 623/12

[58] Field of Search ..... 66/8, 10, 170, 66/171, 172 R, 172 E, 178 A, 182, 190, 166, 202, 215, 81; 623/1, 11, 12

[56] References Cited

U.S. PATENT DOCUMENTS 4,278,717 7/1981 Aoyama .
4,441,215 4/1984 Kaster .
5,366,504 11/1994 Anderson et al. ..... 66/202
5,405,378 4/1995 Strecker ..... 623/1
5,562,725 10/1996 Schmitt et al. .
5,674,276 10/1997 Anderson et al. ..... 66/202
5,718,159 2/1998 Thompson .
5,725,570 3/1998 Heath .
5,733,327 3/1998 Igaki et al. .

*Primary Examiner*—Danny Worrell
*Attorney, Agent, or Firm*—Larson & Larson, P.A.; James E. Larson

[57] ABSTRACT

A stent is made of a fabric interlaced in a knitting machine. The knitting machine receives a plurality of fabric strands and at least one wire strand from spools and knits them into a tubular fabric stent having at least one reinforcing wire interwoven in the fabric. If desired, the spool carrying the wire may rotate more slowly than the yarn spools so that the wire is braided about the yarn locking the yarn together. The wire may be made of materials such as Stainless Steel, Tungsten, Titanium, NITINOL a nickel-titanium alloy, Gold or Silver.

21 Claims, 4 Drawing Sheets

PROCESS FOR MANUFACTURING A WIRE REINFORCED MONOLAYER FABRIC STENT

PRIOR APPLICATION

This application is a continuation-in-part from U.S. Ser. No. 08/957,514, filed Oct. 24, 1997 now abandoned.

BACKGROUND OF THE INVENTION

The present invention relates to a wire reinforced fabric stent and method of weaving. In the prior art, stents are known to be made of interwoven groups of filaments and having a compliant outer covering positioned thereover. U.S. Pat. No. 4,441,215 to Kaster discloses such a configuration. However, Kaster fails to teach or suggest a stent made of a compliant fabric having wire interwoven therewithin. Further, Kaster fails to teach or suggest a particular manner of weaving a stent as disclosed herein.

U.S. Pat. No. 5,718,159 describes a stent having structural strands and three dimensionally braided textile strands integrated together to form a tubular shape. The metal structural strands are heat treated to impart a selected nominal shape in lieu of an original nominal shape. The present inventive process employs two dimensional braiding and there is no need to impart a selected nominal shape to the metal strands.

Applicant is also aware of U.S. Pat. No. 5,562,725 to Schmitt et al. that discloses a radially self-expanding implantable intraluminal device wherein the stent is described as a tubular braid formed from two sets of yarns spiraling in opposing directions about a longitudinal axis of the tube being formed. Schmitt et al. fail to teach the particular interrelationship of reinforcing wire and yarn nor the specific method of weaving disclosed herein.

U.S. Pat. No. 5,178,159 describes a three dimensional braiding process for making a stent having concentric sets of helically wound thread or wire elements. This patent does not describe two dimensional braiding.

A problem in the case of prior art stents made only of wire is that the stent migrates into the vessel wall over a period of time. In an attempt to remedy this situation stents combining wire and textiles have been created. However, such stents in the prior art have ratios of wire to fabric that do not optimize elasticity and axial elongation in the completed stent.

SUMMARY OF THE INVENTION

The present invention relates to a wire reinforced fabric stent having improved elasticity and axial elongation together with a method of weaving. The present invention includes the following interrelated objects, aspects and features:

(1) In a first aspect, the inventive stent is made in a tubular shape woven into a two dimensional braid on a knitting machine. The knitting machine is supplied with yarn from at least three separate spools of yarn and reinforcing wire from at least one spool of wire. As the knitting machine receives the at least three strands of yarn and at least one strand of wire, a tubular stent is gradually formed.

(2) In the preferred embodiment, the reinforcing wire is supplied to the knitting machine at a slower speed than the speed at which the yarn from the other spools is supplied. If desired, a brake mechanism may be provided on the wire spool to prevent the wire from being freely supplied to the knitting machine.

(3) The resulting stent consists of a tubular fabric stent having at least one wire braided about the yarn, locking the yarn together and providing a stent with increased radial strength that can have its profile reduced for introduction into the body.

Accordingly, it is a first object of the present invention to provide a wire reinforced fabric stent and method of weaving.

It is a further object of the present invention to provide such a stent having an increased radial strength with optional elasticity and elongation together with reduced porosity than those in the prior art.

It is yet a further object of the present invention to provide such a stent wherein a knitting machine is supplied with yarn from at least three spools and wire from at least a fourth spool.

It is still a further object of the present invention to provide such a stent wherein the method of weaving the stent in a knitting machine includes the step of supplying wire at a slower speed than yarn.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 3:
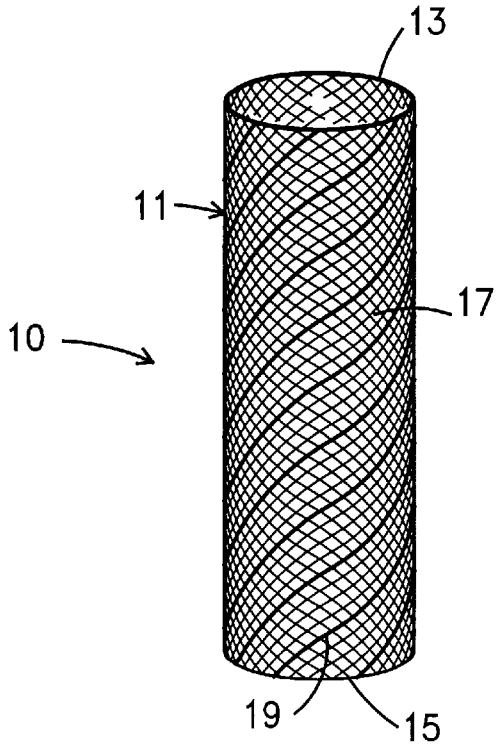
FIG. 3 shows a side perspective view of a preferred finished stent depicting the configuration of reinforcing wires within the fabric weave.

With reference, first, to FIG. 3, a stent in accordance with the teachings of the present invention is generally designated by the reference numeral 10 and is seen to include a tubular body 11 having generally circular open ends 13 and 15. Body 11 consists of a fabric weave preferably formed by a knitting machine and including fabric 17 as well as reinforcing wires 19 spiraling through fabric 17 as shown in FIG. 3.

The stent is formed by two dimensional braiding in which the strands are crossed on top of each other so that strands in the final stent product are tightly held together. Depending on the type of crossing pattern employed and number of strands fed into the braid, the resulting braid will vary in its look. In contrast, three dimensional braiding as used in some prior art stents constitute two different layers of material superimposed concentrically over each other. This latter type of stent has a substantially thicker wall than the present invention of a braided two dimensional stent.

Figure 4:
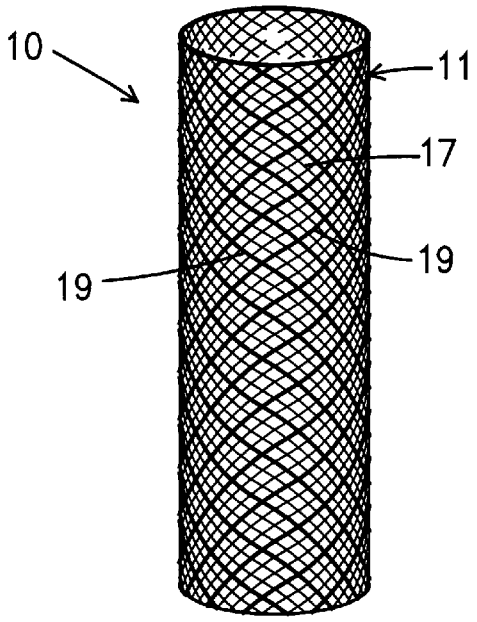
FIG. 4 shows a side perspective view of an alternate finished stent depicting the configuration of reinforcing wires within the fabric weave.
Figure 11:
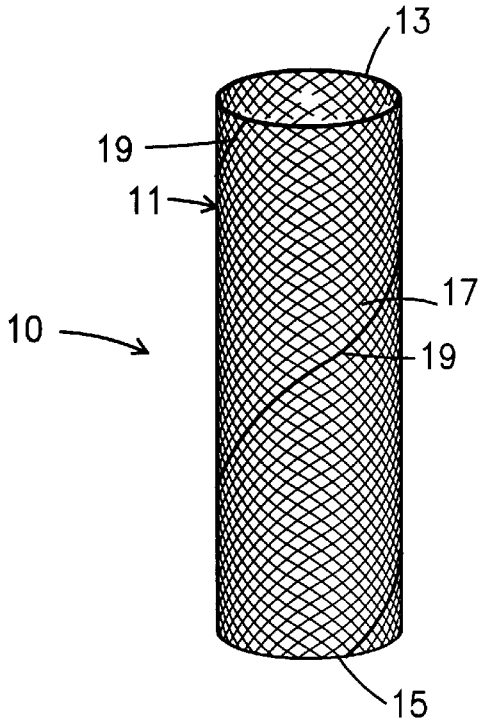
FIG. 11 shows a side perspective view of an alternate finished stent depicting the configuration of one reinforcing wire within the fabric weave.
Figure 12:
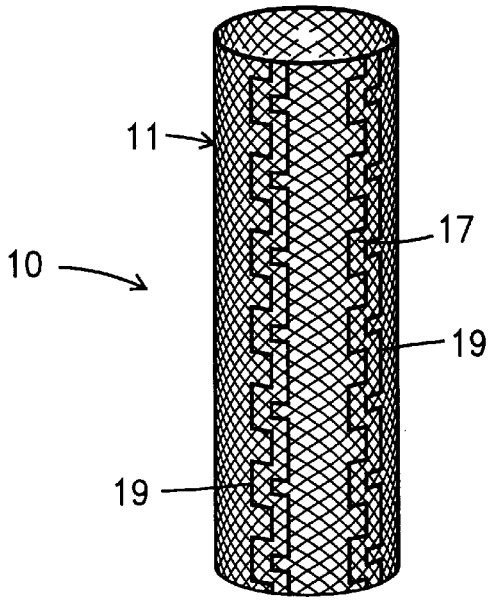
FIG. 12 shows a side perspective view of an alternate finished stent depicting multiple reinforcing wires within the fabric weave in square-wave type patterns.
Figure 13:
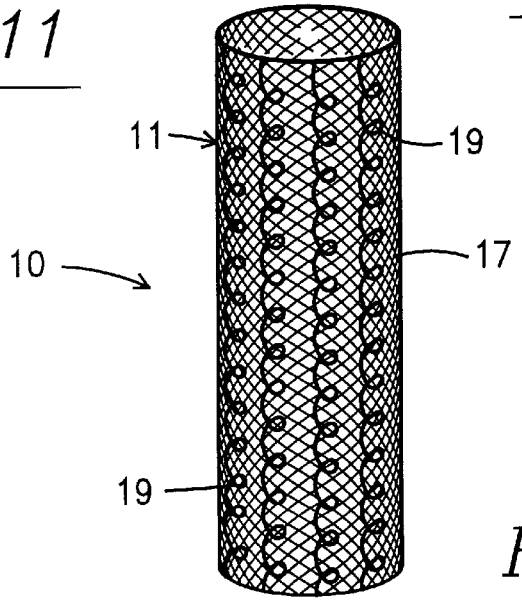
FIG. 13 shows a side perspective view of an alternate finished stent depicting multiple reinforcing wires within the fabric weave in coil-like patterns.

Although the preferred stent of the present invention employs two or more reinforcing wires, stent 10 is not limited thereto and can be configured with one reinforcing wire (see FIG. 11). As seen in FIG. 4, stent 10 employs multiple reinforcing wires 19 that spiral from opposing directions creating a diamond-like wire pattern. As seen in FIG. 13, a single wire 19 is employed spiraling around the circumference of the stent in a generally angled yet parallel configuration. As seen in FIG. 12, multiple wire strands 19 are employed in a square-wave type pattern. Or, as seen in FIG. 13, multiple wires 19 are employed in coil-like patterns. The subject five patterns are not exhaustive of the potential patterns that can be employed in stent 10, but merely depict the preferred embodiment (FIG. 3) and four alternate embodiments (FIGS. 4, 11, 12, and 13) respectively. The wire strand employed can be a monofilament or a braided multifilament.

Figures 1, 2:
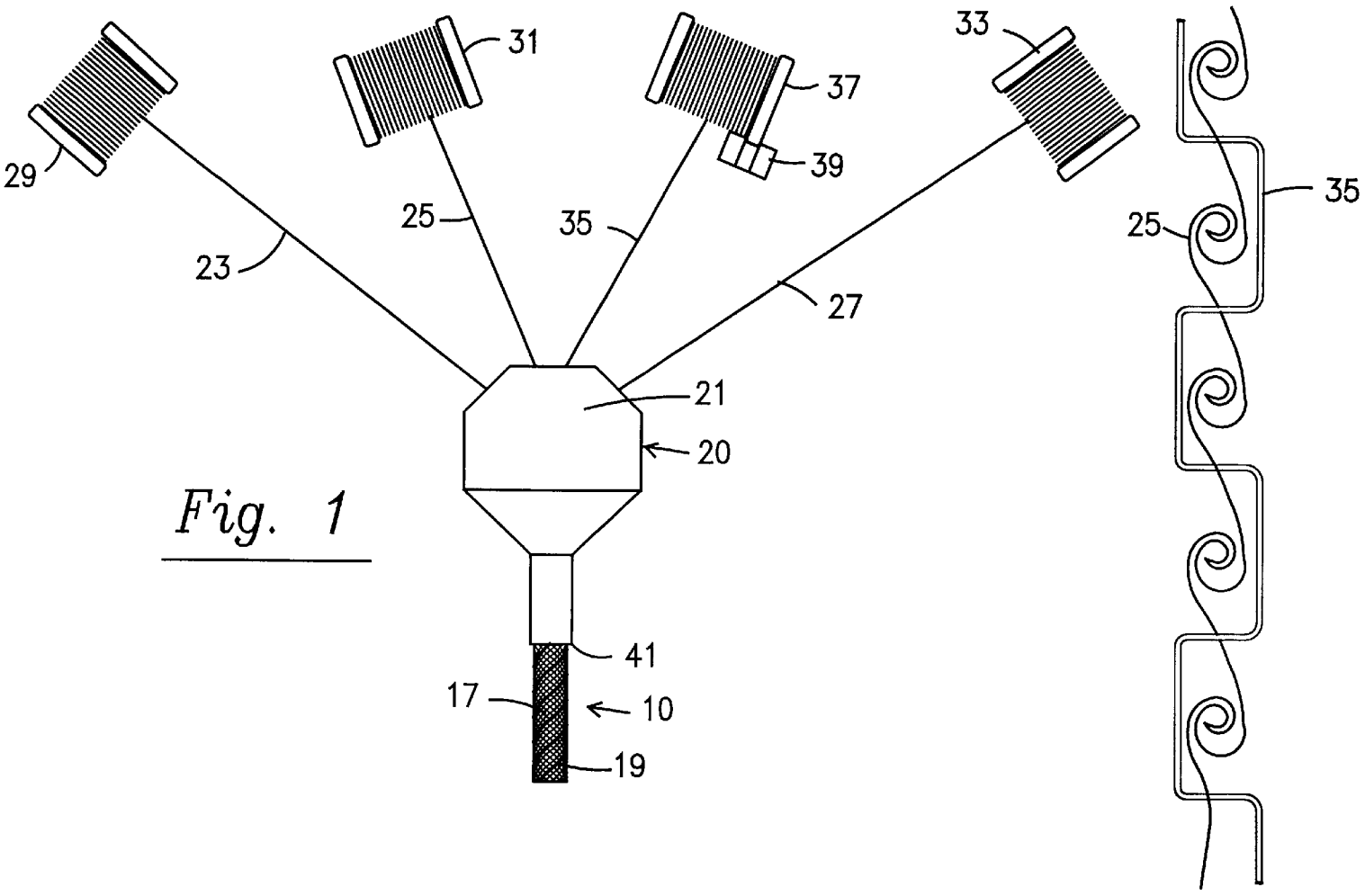
FIG. 1 shows a schematic representation of the use of a knitting machine supplied with yarn and wire to knit a tubular stent.
FIG. 2 shows a schematic representation of the pattern of weaving of the fabric yarn and the reinforcing metal wire.

Stent 10 of the present invention is made using a knitting machine 20 schematically depicted in FIG. 1. It is noted that the preferred stent of the present invention is made with more than one wire strand. Accordingly, FIG. 1 is illustrative of the inventive knitting machine used to create one of the alternate stents of the present invention. As seen in FIG. 11, stent 10 has one wire 19. The preferred stent, as in FIG. 3, would be made from knitting machine 20 employing two or more wire strands and at least three yarn strands. The ratio of metal strands to textile strands is about 1:2.

As seen in FIG. 1, knitting machine 20 includes an intake section 21 receiving strands 23, 25 and 27 of yarn from three respective spools of yarn 29, 31 and 33. Intake section 21 of knitting machine 20 also receives a strand of reinforcing wire 35 from a spool of wire 37. Spool of wire 37 has a braking mechanism 39 acting thereupon for a reason to be described in greater detail hereinafter. An out take 41 of the knitting machine 20 is seen to have, emanating therefrom, the knitted stent 10 having fabric portions 17 and the reinforcing wire 19 spiraling therethrough.

In the preferred method of knitting the stent 10, the spool 37 is caused to supply reinforcing wire 35 at a slower supply rate than is the case for the strands 23, 25 and 27. For this purpose, the brake mechanism 39 is activated to a desired degree of braking force to slow down the supply of wire 35 to a ratio of, for example, 1:4 as compared to the speed of supply of the strands 23, 25 and 27 of yarn.

With reference to FIG. 2, one of the strands of yarn 25 and the reinforcing metal wire strand 35 is shown with the manner of intertwining of these strands being schematically depicted. As should be understood, per unit inch of stent length, a much lengthier portion of the strand of yarn 25 is woven than is the case with the reinforcing wire strand 35. In the example described above, the strand of yarn 25 could be as much as four times as long as the reinforcing wire strand 35 per unit length of the finished stent 10.

As a result of this knitting technique, a stent 10 is woven having a wire strand 35 braided about the yarn portions 17, locking the yarn together and thereby providing a stent with increased radial strength.

In the braiding of wire to textile strand, the wire and textile strand are crossed on top of each other so that the textile is tightly held because of the crossing pattern to produce a stent with low porosity. The crossing pattern determines the appearance of the surface, radial strength of the stent graft and the elasticity in both the radial and longitudinal direction. Elasticity in the longitudinal or axial direction provides a low profile for the stent as it is introduced into a body lumen.

The fabric strand to wire ratio determines the wall thickness for a particular diameter of the stent. For example, in a 4 mm reinforced stent the feed ratio of strands to be braided are different from the feed ratios that are required for a 6 mm stent graft. The optimum yarn to wire ratio insures a small enough stent so it can be moved through the smallest possible hole.

Variations in the denier of the yarn and metal strand thickness or shape also alters the thickness of the stent wall diameter.

This invention produces a stent that does not have areas of blood leakage, but does provide for passage of ions necessary for proper lumen wall function.

The crossing patterns determine the appearance of the surface, radial strength of the stent graft and also the elasticity in both the radial and the longitudinal direction. The elasticity in the longitudinal direction determines how low a profile the device can take for introduction into the body lumen.

The crossing pattern also determines the surface coverage of the stent graft. The surface coverage is necessary to control areas of higher leakage of blood. The stent should have a uniform microporous wall which determines the success of an implant. Blood needs to sweat through the holes, but not leak through the walls.

Compliance of the stent is a factor directly related to the porosity. The more porous the stent graft, the more compliant it is. An optimal compliance is sought which is essential to impart the pulsable nature of the natural arterial wall into the prosthesis.

The wire and the textile strand can be introduced into the braid in separate spools or they can be mixed together in one spool and then introduced into the process. Alternatively, the textile strand and a single wire filament each could be braided into a two filament mixture and then fed by several spools to form a braid.

The preferred ratio of wire strand to textile strand is 1:2. The wall thickness of the stent is such that in the compressed state, a double wall thickness is at least one-fifth (⅕) an end diameter of the stent. For example, if the final end diameter of the stent is 6 mm, the compressed double wall thickness is about 1.20 mm.

In the preferred embodiment of the present invention, the strands of yarn 23, 25, 27 may be made of any suitable fabric material such as, for example, polyester, polypropylene, polyethylene, polyurethane, polytetrafluoroethylene or other natural fabric materials. Such strands of yarn can be monofilament or multi-filament. If monofilament strands are used, the strands can be twisted or wound prior to being fed into the knitting machine 20.

Suitable materials for the reinforcing wire 35 may include Stainless Steel, Tungsten, Titanium, NITINOL a nickel-titanium alloy, Gold or Silver. Furthermore, in the preferred embodiment, the wire 35 may have a diameter of approximately 0.004 inches and is of a greater thickness than that of the yarn. Wire 19 can be round or flat wire. The number of spools supplying yarn is greater than the number of spools supplying the metal wire. In the preferred embodiment, the ratio of the surface area (fabric to metal) is 7:3, but other ratios can be employed.

Figure 5:
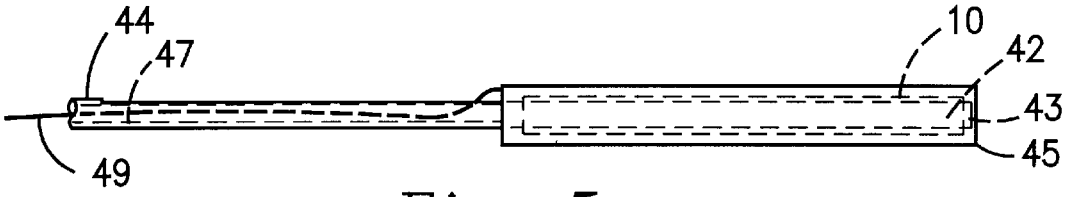
FIG. 5 shows a first step in one method of employing the stent of the present invention.
Figure 6:
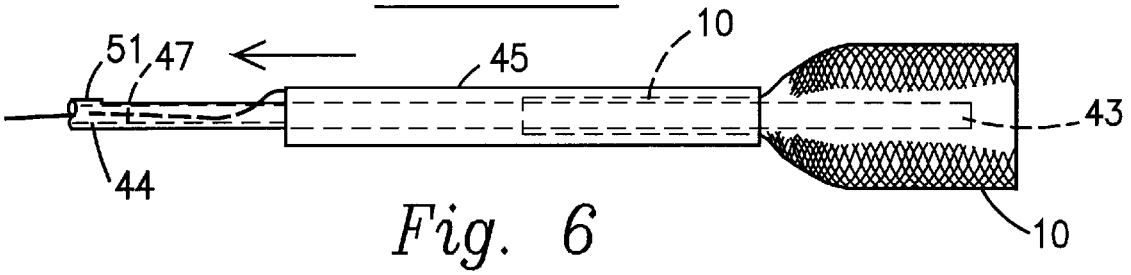
FIG. 6 shows a second step in the one method of employing the stent of the present invention.

As seen in FIGS. 5–10, methods of employment to deliver stent 10 into a vascular or nonvascular system of the body are depicted. As seen in FIGS. 5 and 6, in a first method of employment, stent 10, in a collapsed state, is wrapped about a first end 42 of a catheter 43 and covered by a sheath 45 at catheter first end 42. A catheter second end 44 distal from catheter first end 42 has a slot 47, formed therealong, enclosing a pull wire 49. After delivering the aforementioned mechanism into the body, pull wire 49 is pulled in a direction away from catheter first end 42 (FIG. 6), thereby removing sheath 45 from stent 10 permitting stent 10 to expand. A stop 51 located at catheter second end 44 prohibits sheath 45 from being pulled completely off and provides a means to remove the delivery mechanism from the body.

Figure 7:
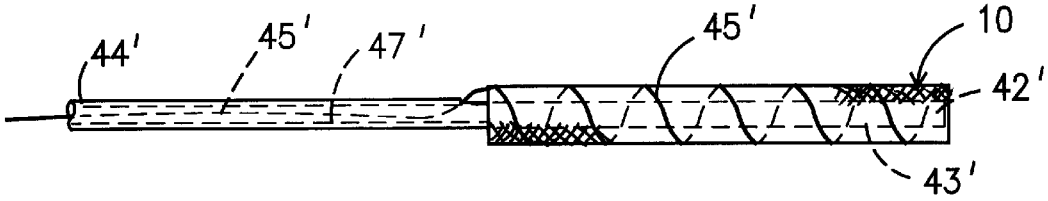
FIG. 7 shows a first step in a second method of employing the stent of the present invention.
Figure 8:
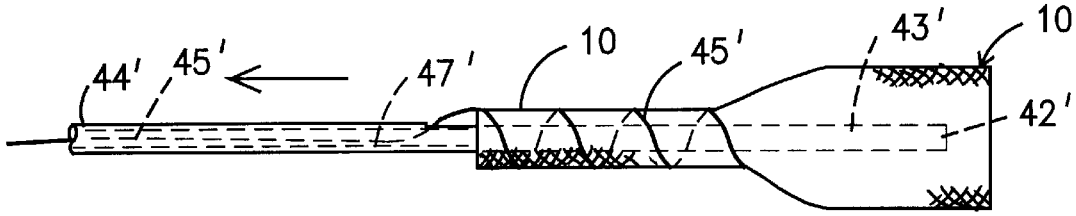
FIG. 8 shows a second step in the second method of employing the stent of the present invention.

As seen in FIGS. 7 and 8, a second method of employing stent 10 into the body is shown. Therein, stent 10 is wrapped about a first end 42' of catheter 43', in a collapsed state, and secured by a wrap wire 45'. Wrap wire 45' feeds into a slot 47' formed within a catheter second end 44'. After the aforementioned mechanism has been delivered within the body, wrap wire 45' is pulled in a direction away from catheter first end 43' such that wrap wire 45' unravels stent 10 (FIG. 8). Stent 10 is thereby permitted to expand. The delivery mechanism is then removed from the body leaving only the expanded stent within the body.

Figure 9:
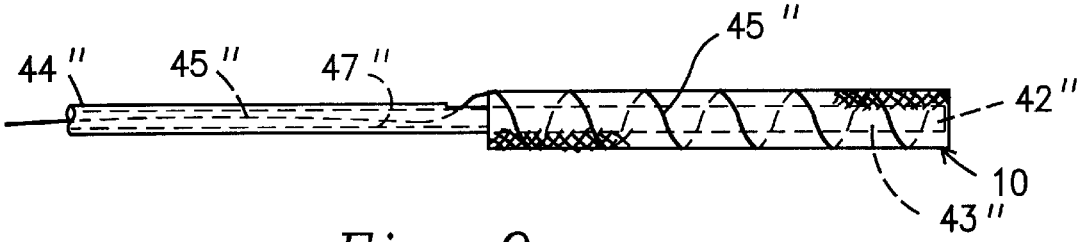
FIG. 9 shows a first step in a third method of employing the stent of the present invention.
Figure 10:
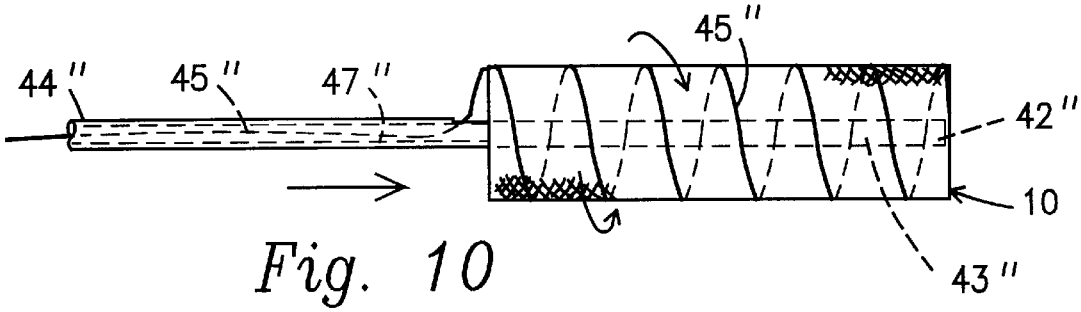
FIG. 10 shows a second step in a third method of employing the stent of the present invention.

As seen in FIGS. 9 and 10, a third method of employment of stent 10 is shown. Therein, stent 10 is again wrapped, in a collapsed state, about a first end 42" of a catheter 43" and secured by a wrap wire 45". Wrap wire 45" feeds into a slot 47" formed within a catheter second end 44". After the aforementioned mechanism has been delivered within the body, wrap wire 45" is twisted such that wrap wire 45" unravels stent 10 (FIG. 10). Stent 10 is thereby permitted to expand. The delivery mechanism is then removed from the body leaving only the expanded stent within the body.

A flat or a round wire is used in the braid, but a flat wire is preferable because it contributes towards optimal wall thickness. The fabric portion provides a barrier similar to an arterial wall to prevent tissue from growing into the stent, but permits transport of ions and other essential elements to and from the arterial wall to the blood.

A preferred configuration of the wire in the braided pattern is that of a "Z" to provide maximum reinforcement of the textile portion.

In a preferred embodiment of the invention the stent is braided so that the fabric portion terminates about an inch prior to termination of the fabric at each end of the stent. In addition, where the stent is designed to accommodate side branches of an artery, sections of the stent at the side branch will be braided so that only wire is exposed to maximize the radial strength of the wire. As is well known in the prior art the stent is coated with biological matter such as anticoagulants or antifibrotic healing agents to make it more compatible with the artery wall tissue. The stent also can be coated with a taxol or epothilone antitumor agent.

Accordingly, an invention has been disclosed in terms of a preferred embodiment thereof which fulfills each and every one of the objects of the present invention as set forth hereinabove and provides a new and useful wire reinforced fabric stent and method of weaving of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. A process for making a stent comprising (a) providing at least one wire strand;

(b) providing a plurality of textile strands;

(c) interlacing the at least one wire strand to the textile strands at a ratio of about 1:2 into a tightly held together monolayer integrated tubular shape having a double wall thickness at least ⅕ an end diameter of the stent, the tubular shape adapted to have axial and radial compressibility for insertion into a vascular or nonvascular system of the body.

2. The process according to claim 1 wherein the wire strands interlaced to the textile strands are selected from the group consisting of stainless steel, tungsten, titanium, nickel-titanium alloy, gold and silver.

3. The process according to claim 1 wherein two wire strands are provided.

4. The process according to claim 3 wherein the two wire strands are interlaced to the textile strands that spiral from opposing directions creating a diamond pattern.

5. The process according to claim 1 wherein the at least one wire strand is a single wire spiraling around the circumference of the stent.

6. The process according to claim 1 wherein the at least one wire strand are multiple wire strands employed in a square-wave pattern.

7. The process according to claim 1 wherein the at least one wire strand is employed in a coil pattern.

8. The process according to claim 1 wherein interlacing the at least one wire strand to the textile strands is carried out in a knitting machine.

9. The process according to claim 8 wherein an intake section of the knitting machine receives at least three strands of yarn and at least one strand of reinforcing wire.

10. The process according to claim 9 wherein a brake mechanism on a spool supplying the wire causes the spool to supply wire at a slower rate than spools supplying the yarn.

11. The process according to claim 1 wherein the textile strands are selected from the group consisting of polyester, polypropylene, polyethylene, polyurethane and polytetrafluoroethylene.

12. A process according to claim 1 wherein the at least one wire strand is provided with a diameter of about 0.004 inches.

13. The process according to claim 1 wherein the at least one wire strand is flat.

14. The process according to claim 1 wherein the at least one wire strands has a "Z" pattern with respect to the textile portion.

15. A process for making a reinforced stent adapted to have axial and radial compressibility for insertion into a blood vessel, the process comprising, (a) providing a knitting machine with an intake portion;

(b) providing multiple textile strands from separate textile supply spools to the intake portion;

(c) providing at least one wire strand to the intake portion from a wire supply spool; and (d) interlacing the at least one wire strand to the textile strands to form a tightly held together monolayer integrated tubular shape having a double wall thickness at least ⅕ an end diameter of the reinforced stent.

16. The process according to claim 15 wherein the wire strand to textile strand ratio is about 1:2.

17. The process according to claim 15 wherein the at least one wire strand are two wire strands.

18. The process according to claim 15 wherein the at least one wire strand has a "Z" pattern with respect to the textile portion.

19. The process according to claim 15 wherein the at least one wire strand is a braided multifilament.

20. The process according to claim 15 wherein the reinforced stent is coated with biological matter selected from the group consisting of anticoagulants and antifibrotic healing agents.

21. The process according to claim 15 wherein the reinforced stent is coated with an antitumor agent selected from the family consisting of taxol and epothilone.

* * * * *